US010802523B2

(12) United States Patent
Londak et al.

(10) Patent No.: US 10,802,523 B2
(45) Date of Patent: Oct. 13, 2020

(54) SYSTEM AND METHOD FOR CONTROLLING A LOW-DROPOUT REGULATOR

(71) Applicant: SEMICONDUCTOR COMPONENTS INDUSTRIES, LLC, Phoenix, AZ (US)

(72) Inventors: Pavel Londak, Hutisko Solanec (CZ); Jan Matej, Roznov pod Radhostem (CZ); Petr Rozsypal, Hutisko Solanec (CZ)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 16/513,978

(22) Filed: Jul. 17, 2019

(65) Prior Publication Data

US 2020/0285260 A1 Sep. 10, 2020

Related U.S. Application Data

(60) Provisional application No. 62/815,114, filed on Mar. 7, 2019.

(51) Int. Cl.
*G05F 1/575* (2006.01)
*G05F 1/565* (2006.01)

(52) U.S. Cl.
CPC ..... *G05F 1/575* (2013.01); *G05F 1/565* (2013.01)

(58) Field of Classification Search
CPC . G05F 1/56; G05F 1/565; G05F 1/567; G05F 1/573; G05F 1/575; H02M 1/44
USPC ..... 323/222, 273, 274, 277, 280, 311
See application file for complete search history.

(56) References Cited

U.S. PATENT DOCUMENTS 8,115,461 B2 * 2/2012 Yoshio ..... G05F 1/56 323/266
9,484,888 B2 * 11/2016 Yang ..... H03F 3/45197
2002/0070794 A1 * 6/2002 Gariboldi ..... H02M 3/073 327/540
2004/0263238 A1 * 12/2004 Thorp ..... H02M 3/073 327/536
2006/0145748 A1 * 7/2006 Ki ..... H02M 3/073 327/536

(Continued)

OTHER PUBLICATIONS

Texas Instruments, "TPS40170 4.5 V to 60 V, Wide-Input Synchronous PWM Buck Controller," Nov. 2013, revised Dec. 2014.

*Primary Examiner* — Yemane Mehari
(74) *Attorney, Agent, or Firm* — Brake Hughes Bellermann LLP

(57) ABSTRACT

A system and method for controlling a low-dropout regulator (LDO) is disclosed. The system and method includes a charge pump that is controlled to provide a charge pump voltage to power the LDO. The charge pump voltage can be adjusted relative to the LDO's input voltage to ensure efficient operation of the LDO for input voltages over a range. The charge pump is also controlled to limit the maximum charge pump voltage provided to ensure safe operation of the LDO. The system and method also includes a under voltage lockout circuit that enables the LDO when it is determined that the charge pump voltage is sufficient to meet multiple criteria enable For example, the charge pump voltage may be analyzed to determine if it is above a minimum voltage and also sufficiently higher than the LDO's output voltage.

20 Claims, 7 Drawing Sheets

(56) References Cited

U.S. PATENT DOCUMENTS

2007/0263419 A1* 11/2007 Sasaki ..... H02M 1/36
363/49
2008/0100272 A1* 5/2008 Yoshio ..... G05F 1/56
323/266
2013/0307576 A1* 11/2013 Ilkov ..... G01R 31/2822
324/762.02
2014/0103862 A1* 4/2014 Ahn ..... H03K 3/02335
320/107
2015/0008871 A1* 1/2015 Petenyi ..... G05F 1/625
320/107
2015/0180458 A1* 6/2015 Masferrer ..... H03K 5/1565
327/175
2015/0309518 A1* 10/2015 Nagda ..... G05F 1/468
323/274
2016/0173992 A1* 6/2016 Nicollini ..... H04R 19/04
381/113
2018/0048232 A1* 2/2018 Adell ..... H03L 7/085

* cited by examiner

SYSTEM AND METHOD FOR CONTROLLING A LOW-DROPOUT REGULATOR

CROSS-REFERENCE TO RELATED APPLICATIONS

This application claims the benefit of U.S. Provisional Patent Application No. 62/815,114, filed on Mar. 7, 2019, the entire contents of which is incorporated herein by reference.

FIELD OF THE DISCLOSURE

The present disclosure relates to a low dropout voltage regulator (i.e., LDO), and more specifically to a system, circuit, and method for generating a voltage to power the LDO and for enabling/disabling the LDO to ensure safe and efficient operation.

BACKGROUND

A low-dropout regulator (i.e., LDO) is a voltage regulator that receives an unregulated input voltage (i.e., $V_{IN}$) and provides a regulated output voltage (i.e., $V_{OUT}$) with a low dropout (e.g., $V_{IN}$-$V_{OUT}$~100 millivolts). In general, an LDO includes a transistor device (e.g., N-type transistor) that is series connected between the input and the output of the LDO. The LDO also includes a driver (i.e., error amplifier, gate driver, etc.) that operates in a feedback loop between the output of the LDO and a controlling terminal (e.g., gate) of the transistor device. The output of the driver is coupled to the controlling terminal to adjust operating point of the transistor device for regulation. The other two terminals of the transistor device (e.g., drain, source) are connected to the input and the output of the LDO, respectively. The driver controls the voltage drop across the transistor device based on feedback to regulate the output voltage of the LDO.

SUMMARY

In one general aspect, the present disclosure describes a voltage regulator system. The voltage regulator system includes a LDO that is configured to receive an input voltage and to provide a regulated output voltage. The system further includes a charge pump configured to power the LDO and a charge pump control circuit configured to control the charge pump. In particular, the charge pump is controlled to output a charge pump voltage that is (i) higher than the input voltage and (ii) does not exceed a maximum voltage. The system further includes an under voltage lockout (UVLO) circuit that is configured to enable the LDO when the charge pump voltage is (i) higher than a minimum voltage for operation of the LDO (i.e., the minimum voltage expected at the input plus a voltage to insure operation of a transistor device in the LDO) and (ii) sufficiently higher than the regulated output of the LDO to insure operation of the transistor device (i.e., higher than the output voltage by a particular voltage).

In another general aspect, the present disclosure describes a circuit for control of an LDO. The circuit includes a charge pump control circuit that is configured to receive an input voltage from an input terminal of the LDO and also to receive a charge pump voltage from a charge pump (i.e., from an output terminal of the charge pump). The charge pump control circuit controls the charge pump based on the input voltage and the charge pump voltage. The charge pump voltage provides power to the LDO. The circuit further includes a UVLO circuit that is configured to receive the charge pump voltage and to enable the LDO when the charge pump voltage satisfies a plurality of conditions (i.e., criteria).

In another general aspect, the present disclosure describes a method for controlling an LDO. The method includes receiving an input voltage from an input of the LDO, and receiving a charge pump voltage from an output of the charge pump. The charge pump voltage is adjusted (e.g., changed) based on the received input voltage and the received charge pump voltage. The adjusted charge pump voltage is then provided to the LDO for power (i.e., as a voltage of a voltage rail used by the LDO for operation). Additionally, the method includes determining that the adjusted charge pump voltage satisfies (i.e., meets) a plurality of (i.e., multiple) conditions. Based on the determination, the LDO is enabled for operation.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The components in the drawings are not necessarily to scale relative to each other. Like reference numerals designate corresponding parts throughout the several views.

DETAILED DESCRIPTION

Figure 1:
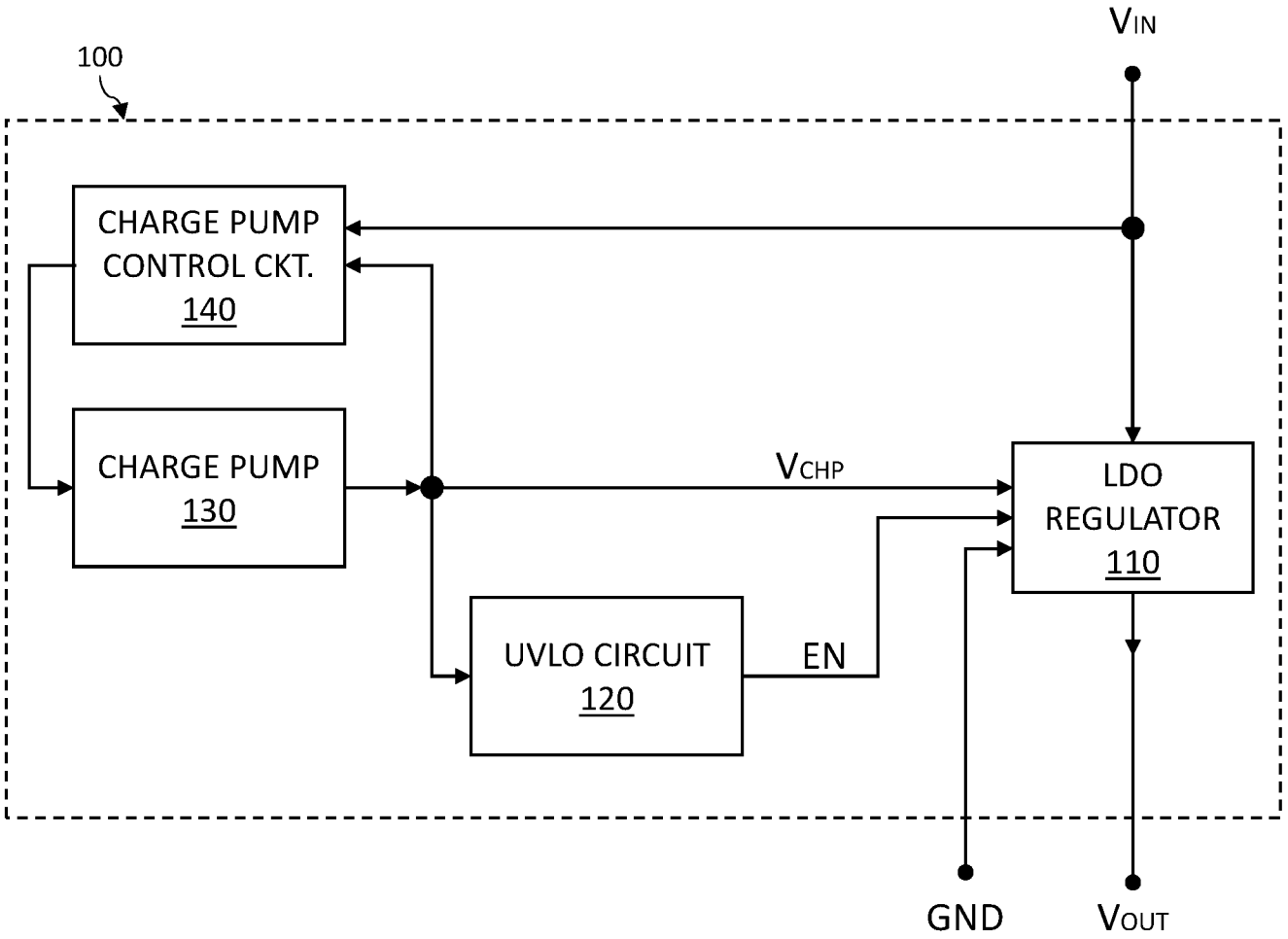
FIG. 1 is a block diagram of a voltage regulator system according to an implementation of the present disclosure.

FIG. 1 schematically illustrates a block diagram a voltage regulator system 100 according to implementation of the present disclosure. The system 100 may be configured to receive, at respective input terminals, an input voltage ($V_{IN}$) and a ground voltage (GND). The system 100 may be configured to transmit (i.e., output), at an output terminal, an output voltage ($V_{OUT}$). The output voltage is regulated so that variations (e.g., ripples) in the input voltage are not reflected in the output voltage. The output voltage is lower (i.e., less than) than the input voltage by a dropout voltage (i.e., $V_{DO}=V_{IN}-V_{OUT}$).

The system 100 includes a low-dropout regulator (i.e., LDO) 110 that is configured to regulate the output voltage ($V_{OUT}$) lower than the input voltage ($V_{IN}$) for a small dropout voltage (e.g., $V_{DO}\leq 100$ millivolts (mV)). The LDO 110 dissipates power during regulation. The power dissipated is proportional to the dropout voltage ($V_{DO}$). Accordingly, reducing $V_{DO}$ may decrease regulation loss and reduce heat dissipation requirements.

Figure 2:
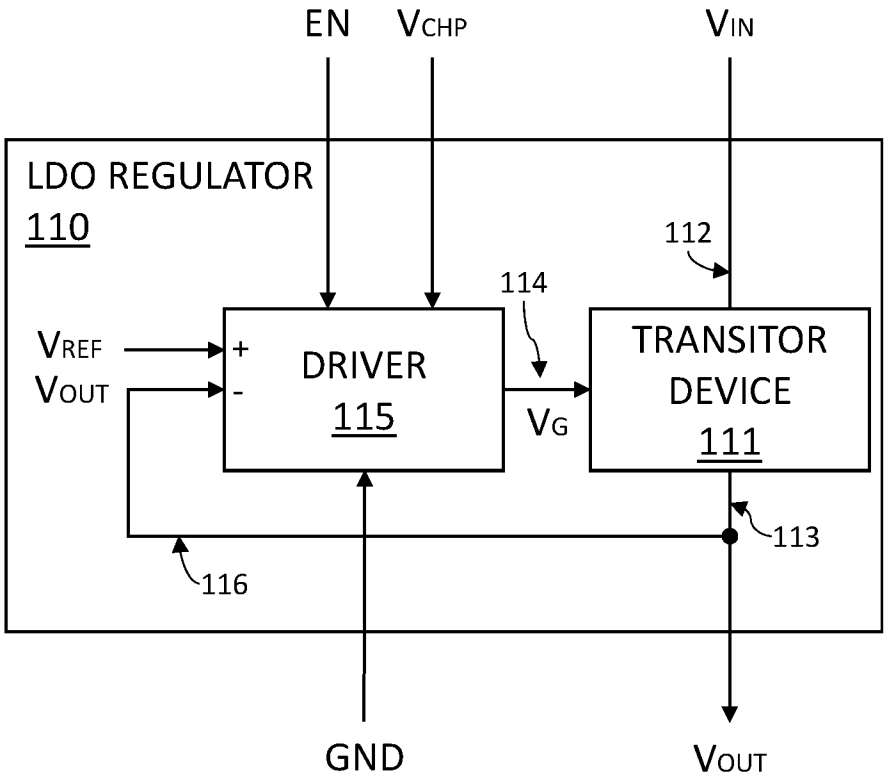
FIG. 2 is a block diagram of a low dropout regulator that could be used with the system of FIG. 1.

A block diagram of a possible LDO 110 is shown in FIG. 2. The LDO 110 includes a transistor device 111. The transistor device 111 may be implemented using a variety of transistors types (e.g., BJT, MOSFET, JFET, etc.). For example, the transistor device 111 may be an N-channel or a P-channel MOSFET. In practice, an N-channel MSOFET LDO may offer advantages over other types of transistor devices. For example, an N-channel MOFET LDO may provide a lower dropout (i.e., $V_{DO}$) than a P-channel MOSFET LDO. Accordingly, while the transistor device 111 of the present disclosure is not limited to any particular transistor type or technology, the N-channel enhancement-mode MOSFET will be described as the transistor device 111.

Regulation may be accomplished by controlling the voltage drop across the transistor device 111. For example, the voltage drop between a drain terminal (D) 112 and a source terminal (S) 113 of an N-channel MOSFET may be controlled by a voltage applied to a gate terminal (G) 114 of the N-channel MOFFET.

The LDO 110 includes a driver circuit (i.e., driver) 115 to provide the voltage at the gate terminal 114 of the transistor device 111. The driver 115 may be configured to receive the output voltage ($V_{OUT}$) via a feedback loop 116 formed between the driver 115 and the transistor device 111. The driver 115 may also be configured to receive a reference voltage ($V_{REF}$). When enabled, the driver may function as a difference amplifier with an output voltage ($V_G$) based on (i.e., corresponding to) the difference between the reference voltage and the output voltage (i.e., $V_{REF}-V_{OUT}$). The driver's output voltage $V_G$ may be applied to the gate 114 of the transistor device 111 to control operating point of the transistor (i.e., its conduction, its voltage drop ($V_{DO}$), etc.).

The driver 115 is powered for operation by an upper voltage ($V_{CHP}$) (i.e., upper rail) and a lower voltage (GND) (i.e., lower rail). The lower voltage (GND) for driver may also be the reference voltage of $V_{IN}$. In other words, the LDO and the input voltage share the same voltage domain. To provide adequate control of the transistor device 111, $V_{CHP}$ can be higher than the input voltage $V_{IN}$. For example, if the input voltage $V_{IN}$ is 1 volt (V) (i.e., at the drain terminal 112) and the dropout voltage is 0.1V (i.e., $V_{IN}$=1V, $V_{DO}$=0.1V), then the voltage at the output of the transistor device (i.e., at the source terminal 113) may be 0.9V (i.e., $V_{OUT}$=0.9V). For the transistor device 111 to conduct (i.e., operate in an ON state), the voltage at the output of the driver 115 can be at least 0.9V plus the threshold voltage ($V_T$) of the transistor device 111. For a threshold voltage of 0.7 V (i.e., $V_T$=0.7)) the driver outputs a voltage of at least 1.6V (i.e., $V_G \geq 1.6V$). Accordingly, the driver may be powered by an upper voltage that can enable the driver to output at least 1.6V. Thus, in an implementation of the LDO 110, the upper voltage supplying the driver 115 is configured to be higher than the input voltage (i.e., $V_{CHP}>V_{IN}$). An upper voltage ($V_{CHP}$) configured as a single value that is higher than all expected input voltages ($V_{IN}$) may be inefficient (e.g., when $V_{IN}$ is low) and could lead to added cost and/or size. The circuits and methods of the present disclosure advantageously provide an upper value ($V_{CHP}$) that is based on the input voltage ($V_{IN}$) in order to provide efficient operation.

The driver 115 may be enabled for operation by an enable signal EN. The enable signal EN may be a digital signal for which a low voltage (i.e., a logical zero) disables operation of the driver 115 and for which a high voltage (i.e., a logical one) enables operation of the driver 115 (or vice versa). The enable signal may be used to turn OFF the LDO 110 in the event that a voltage drops below a desired (e.g., target, threshold) value. This control may be useful for protection (e.g., of devices coupled to the system 100). The circuits and methods of the present disclosure advantageously utilize multiple criteria to determine the state of the enable signal EN.

Returning to FIG. 1, the system 100 further includes a charge pump 130 and a charge pump control circuit 140 to generate the upper voltage \imp and an under-voltage lock-out circuit 120 to generate the enable signal EN.

Figure 3:
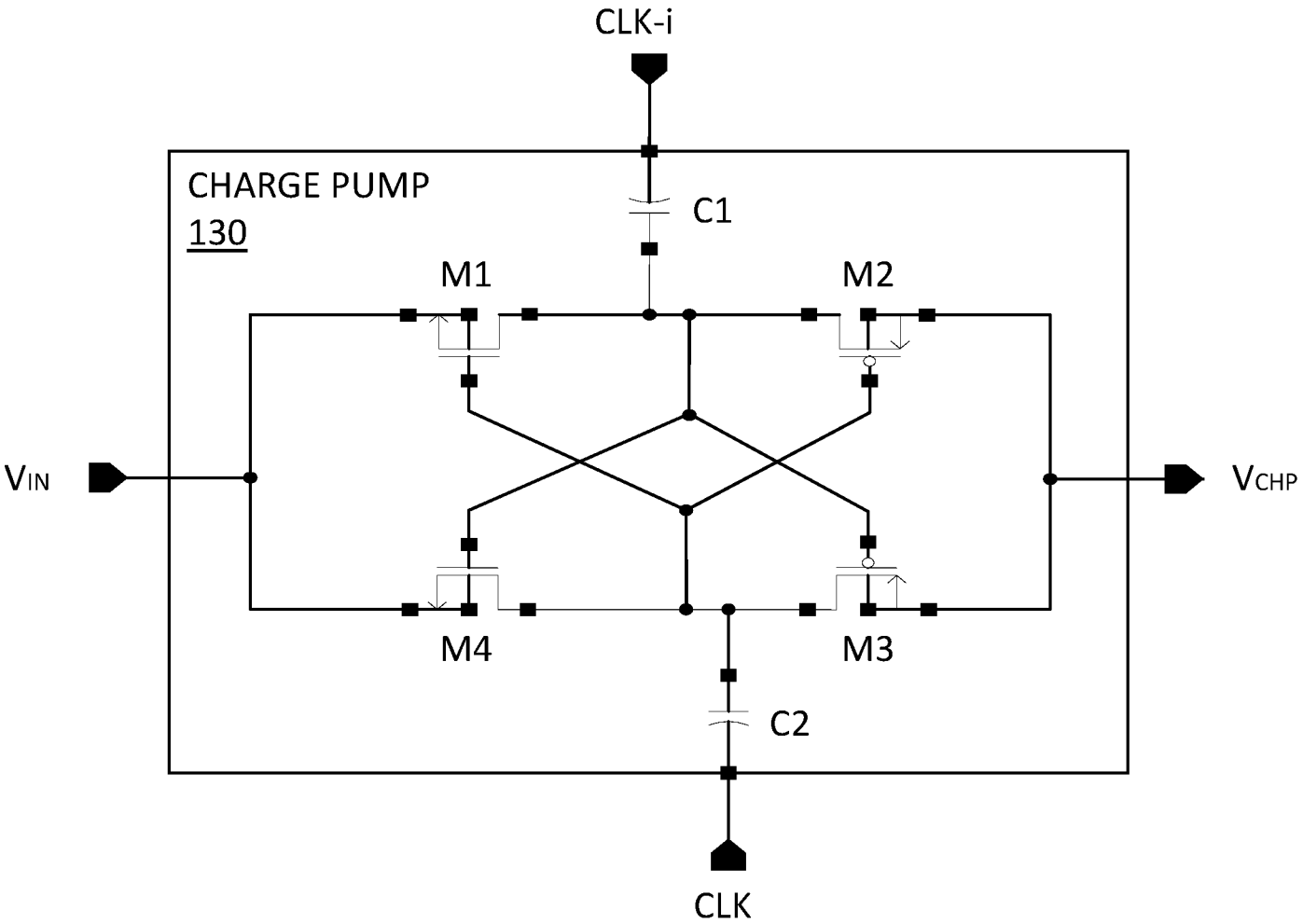
FIG. 3 is a schematic of a charge pump that could be used with the system of FIG. 1.

An example of a charge pump circuit is shown in FIG. 3. The example charge pump shown is provided to help understanding and not as a limiting example of the disclosure. The disclosed systems, circuits, and methods may be used with other charge pump types and architectures. For example, one possible implementation of a charge pump suitable for use with the system 100 is disclosed in U.S. patent application Ser. No. 16/183,844, the entire contents of which is incorporated herein by reference. In the disclosure, a charge pump circuit similar to that shown in FIG. 3 is described. The charge pump circuit, however, includes input switches and output switches that are individually controlled by different clock signals to alternatively couple energy storage capacitors to an input and to an output. The individualized switching control allows for the use of clock signals with no overlapping transitions to improve conversion efficiency. Additionally, the input switches are controlled by clock signals that are level shifted relative to the input voltage. The level shifted switching control also improves efficiency and allows for a range in input voltages to be accommodated for DC voltage conversion.

The charge pump 130 is a cross-coupled symmetrical charge pump that receives the input voltage $V_{IN}$ and creates a higher voltage $V_{CHP}$ that is used to power the system 100 (e.g., the driver 115). The voltage increase is achieved by charging and discharging a pair of capacitors C1, C2 using a network of transistors operating as switches controlled by a clock signal (CLK) and its inverse (CLK-i). For example, when CLK is a high signal and CLK-i is a low signal then transistors M1 and M3 are ON (i.e., conduct) while transistors M4 and M2 are OFF (i.e., resist). In this state, the capacitor C1 is coupled to the input and is charged by $V_{IN}$. When CLK is a low signal (e.g., GND) and CLK-i is a high signal then transistors M1 and M3 are OFF while transistors M4 and M2 are ON. In this state, the capacitor C1 is coupled to the output. By alternatively charging and discharging respective capacitors (C1, C2) $V_{CHP}$ is generated at a higher value than $V_{IN}$. The precise higher value depends on the clock signals (CLK, CLK-i). For example, the frequency of the clock signals may correspond to the voltage at the output of the charge pump ($V_{CHP}$).

In order to control the charge pump voltage $V_{CHP}$, the system 100, as shown in FIG. 1, can include a charge pump control circuit 140. The charge pump control circuit controls the charge pump 130 to generate a charge pump voltage ($V_{CHP}$) based on the input voltage ($V_{IN}$) appearing at the input of the LDO 110 and based on the charge pump voltage fed back to the input of the charge pump control circuit from the charge pump. The amplitude of the generated charge pump voltage ($V_{CHP}$) is adjusted to exceed the input voltage ($V_{IN}$). The exact value of $V_{CHP}$ and/or the relationship between $V_{CHP}$ and $V_{IN}$ may be based on operation (e.g., stability, efficiency) for a range of $V_{IN}$ (e.g., 1.1V to 3.6V). In some implementations, the charge pump control circuit 140 may be further configured to limit the charge pump voltage ($V_{CHP}$) to a maximum voltage ($V_{CHPMAX}$) to prevent damage (e.g., as determined by a process safe operating area (SOA)).

Figure 4:
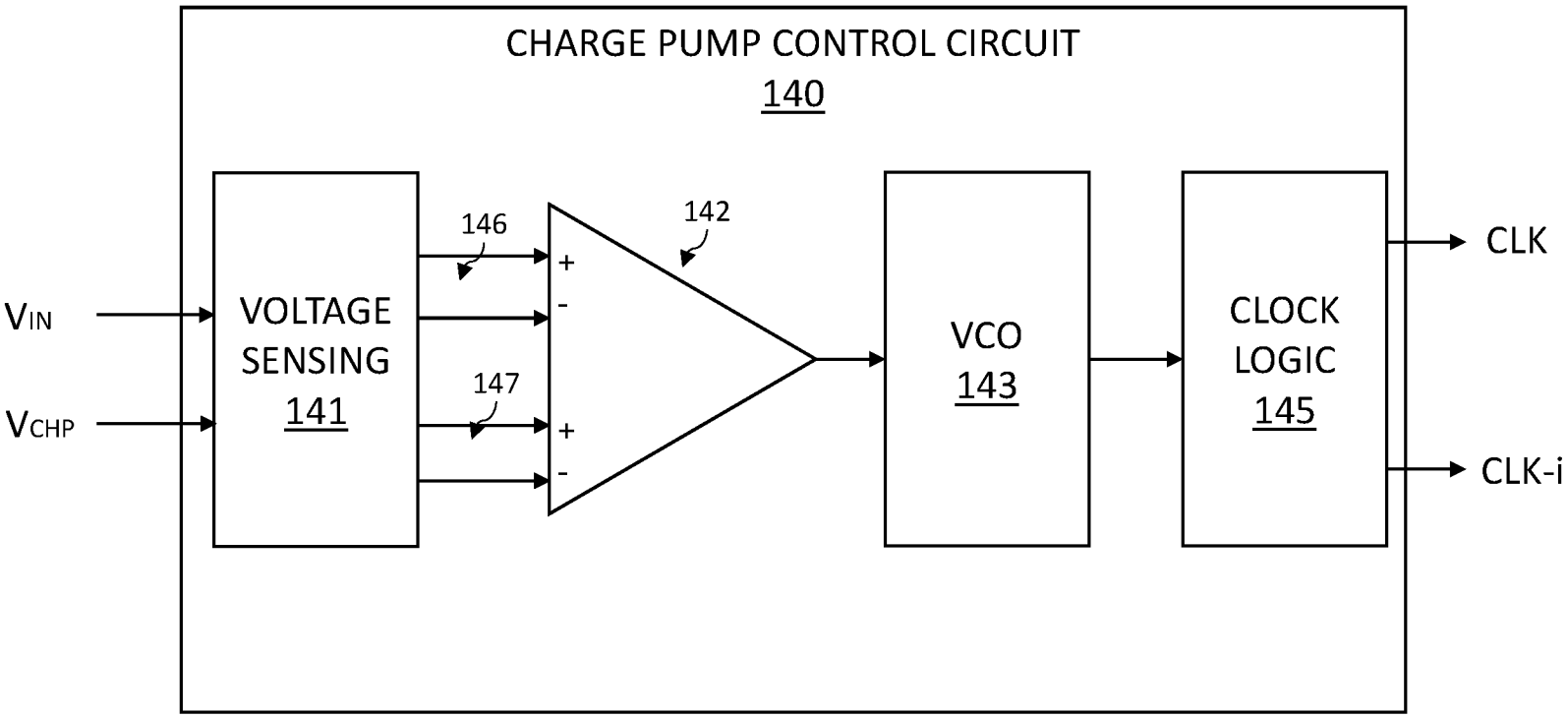
FIG. 4 is a block diagram of a charge pump control circuit that could be used with the system of FIG. 1.

A block diagram of a possible charge pump control circuit 140 is shown in FIG. 4. The charge pump control circuit 140 can be configured to generate/control clock signals (CLK, CLK-i) for the charge pump based on received voltages ($V_{IN}$, $V_{CHP}$). For example, the amplitude of the clock signals (CLK, CLK-i) may be equal to the amplitude of the received input voltage ($V_{IN}$). Additionally or alternatively, the frequency of the clock signals (CLK, CLK-i) may adjusted according to (e.g., in proportion with) the amplitude of the received input voltage ($V_{IN}$). The charge pump control circuit 140 can also be configured to limit the adjustment of the frequency of the clock signals to a maximum value to damage to the charge pump and/or to prevent the output of the charge pump ($V_{CHP}$) from damaging other circuits.

As shown in FIG. 4, the charge pump control circuit may include a voltage sensing stage 141. The voltage sensing stage (i.e., circuit) is configured to create floating voltage levels relative to $V_{CHP}$. Accordingly, the voltage sensing stage may include a voltage divider or voltage regulation devices (i.e., voltage reference) to set one or more voltages relative to $V_{IN}$ and/or $V_{CHP}$. This may be helpful to adapt the voltage levels of $V_{IN}$ and $V_{CHP}$ to other voltage domains.

The charge pump control circuit 140 also includes a differential amplifier 142 that is configured to perform one or more (e.g., two) comparisons. A first comparison 146 compares relative amplitudes related to $V_{CHP}$ and $V_{IN}$. A second comparison 147 compares a relative amplitude of $V_{CHP}$ to a voltage related to a maximum voltage for safe and/or proper function of the charge pump. The differential amplifier 142 may respond to the comparisons differently. For example, a second comparison that determines that \imp is at or higher than a maximum voltage may cause the amplifier to disregard (i.e., suppress) the first comparison. Whereas when the second comparison determines that $V_{CHP}$ is lower than a maximum voltage then the output of the amplifier may be determined by the relationship between $V_{CHP}$ and $V_{IN}$ (i.e., by the first comparison).

The differential amplifier 142 drives a voltage controlled oscillator (VCO) 143. The VCO is configured to receive an input voltage and to generate an oscillating signal with a frequency corresponding to a voltage at the input of the VCO (e.g., $V_{IN}$–$V_{CHP}$). The charge pump control circuit further includes clock logic 145 that receives the oscillating signal from the VCO and generates a corresponding digital clock signal (CLK) and a complementary (i.e., inverse) clock signal (CLK-i). The clock signals control the charge pump 130 as described previously.

The charge pump 130 and the charge pump control circuit 140 can operate together to produce a voltage ($V_{CHP}$) that is relatively higher than the input voltage ($V_{IN}$) by a fixed amount (i.e., the same regardless of how $V_{IN}$ changes) but that is less than (or equal to) a maximum voltage ($V_{CHP\text{-}MAX}$). The maximum voltage may be selected to correspond to a maximum voltage rating for the device technology of the LDO.

As shown in FIG. 1, the system 100 can include an under-voltage lock-out (UVLO) circuit 120. Generally, the UVLO circuit 120 disables operation (via the enable signal EN) when the charge pump voltage ($V_{CHP}$) is at or below a minimum voltage ($V_{CHPMIN}$). In other words a single criterion is used to determine whether to enable or disable the driver 115. An advantageous aspect of the disclosed UVLO circuit is that it may use multiple criteria and logic to determine whether to enable or disable the driver 115. For example, the UVLO circuit may additionally determine that the charge pump voltage ($V_{CHP}$) is above the output voltage of the LDO 110 by a certain amount before enabling operation of the driver to ensure transistor device 111 can be controlled.

Figure 5:
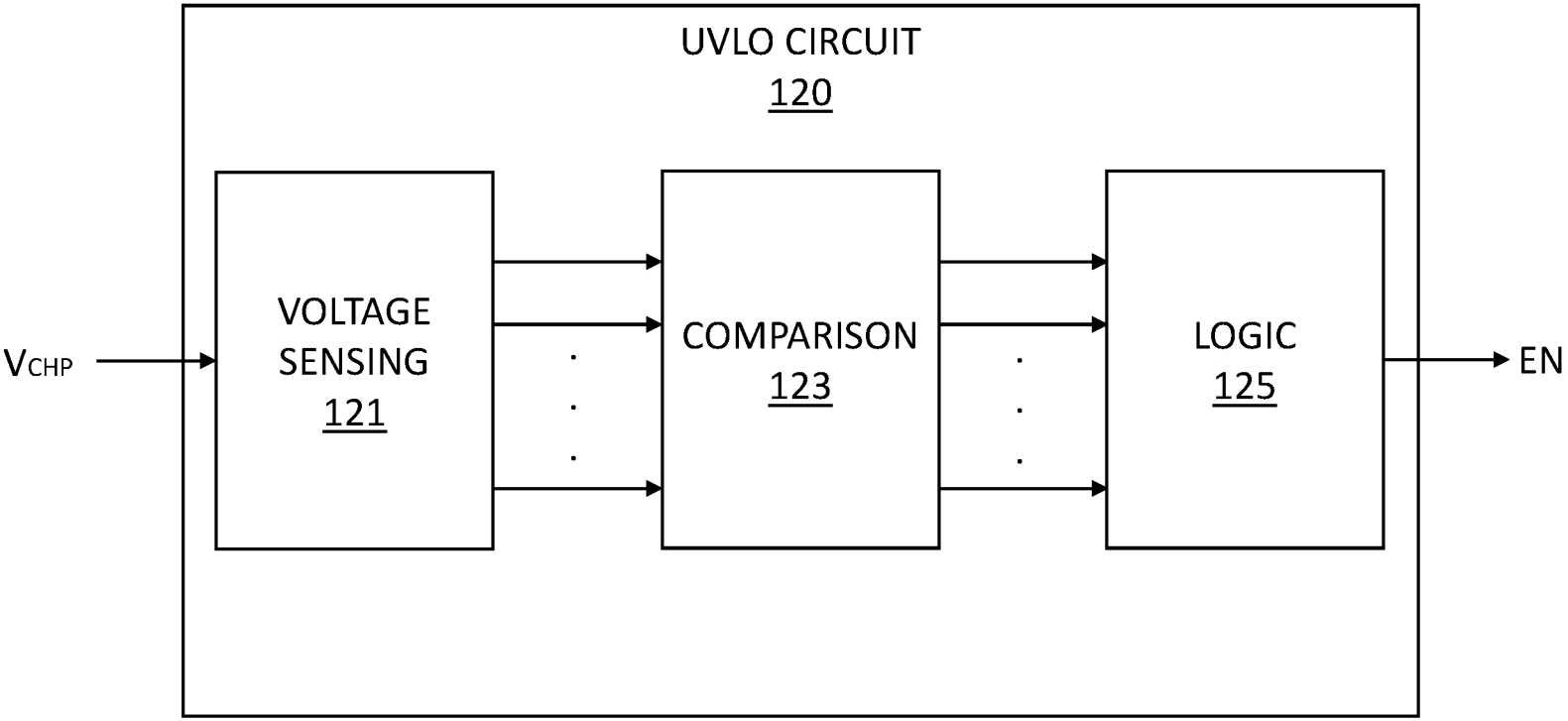
FIG. 5 is a block diagram of an under-voltage lock-out (UVLO) circuit could be used with the system of FIG. 1.

A block diagram of a possible implementation of the UVLO circuit 120 is shown in FIG. 5. The UVLO circuit receives the charge pump voltage ($V_{CHP}$) and outputs an enable signal (EN). The enable signal may be a digital signal EN that, based on its state (e.g., high/low, I/O, etc.), can enable/disable the operation of the driver 115 of the LDO 110. The UVLO circuit 120 includes a voltage sensing stage (i.e., voltage sensing circuit, voltage sensing) that receives, creates, and/or manipulates voltages for comparison. Accordingly, the voltage sensing 121 may include circuitry (e.g., voltage source, voltage regulator, voltage reference, etc.) to output a voltage level that is relative (i.e., floating) to another (e.g., $V_{CHP}$) and/or to output a voltage relative to a ground voltage. The UVLO circuit may provide one or more output voltages to a comparison stage (i.e., comparison circuit, comparison) for comparison. Accordingly, the comparison 123 may include circuitry to determine relative voltage conditions. For example, a comparator may be used to indicate that a first voltage is higher than a second voltage. The comparison 123 outputs one or more signals (e.g., digital signals) that indicate the results of the voltage level comparisons. The UVLO circuit also includes a logic stage (e.g., logic circuit, logic). The logic 125 may include one or more logic gates (e.g., inverter, AND, OR, XOR, etc.) that generate an enable signal (EN) based on a logical analysis applied to the one or more results of the comparison 123. Thus, the state (high/low, I/O, ON/OFF) of the enable signal may be based on (one or) multiple criteria. To avoid confusion it may be noted that other enable signals are possible for the voltage regulator system. For example an enable signal (e.g., applied externally) may be used to control the overall operation of the voltage regulator system. The enable signal (EN) described herein is a signal that is generated and applied within the voltage regulator system to control the driver. The naming of this signal as "enable" (i.e., EN) should not be understood as replacing or precluding other possible enable signals that are used for other (e.g., different) purposes.

Figure 6:
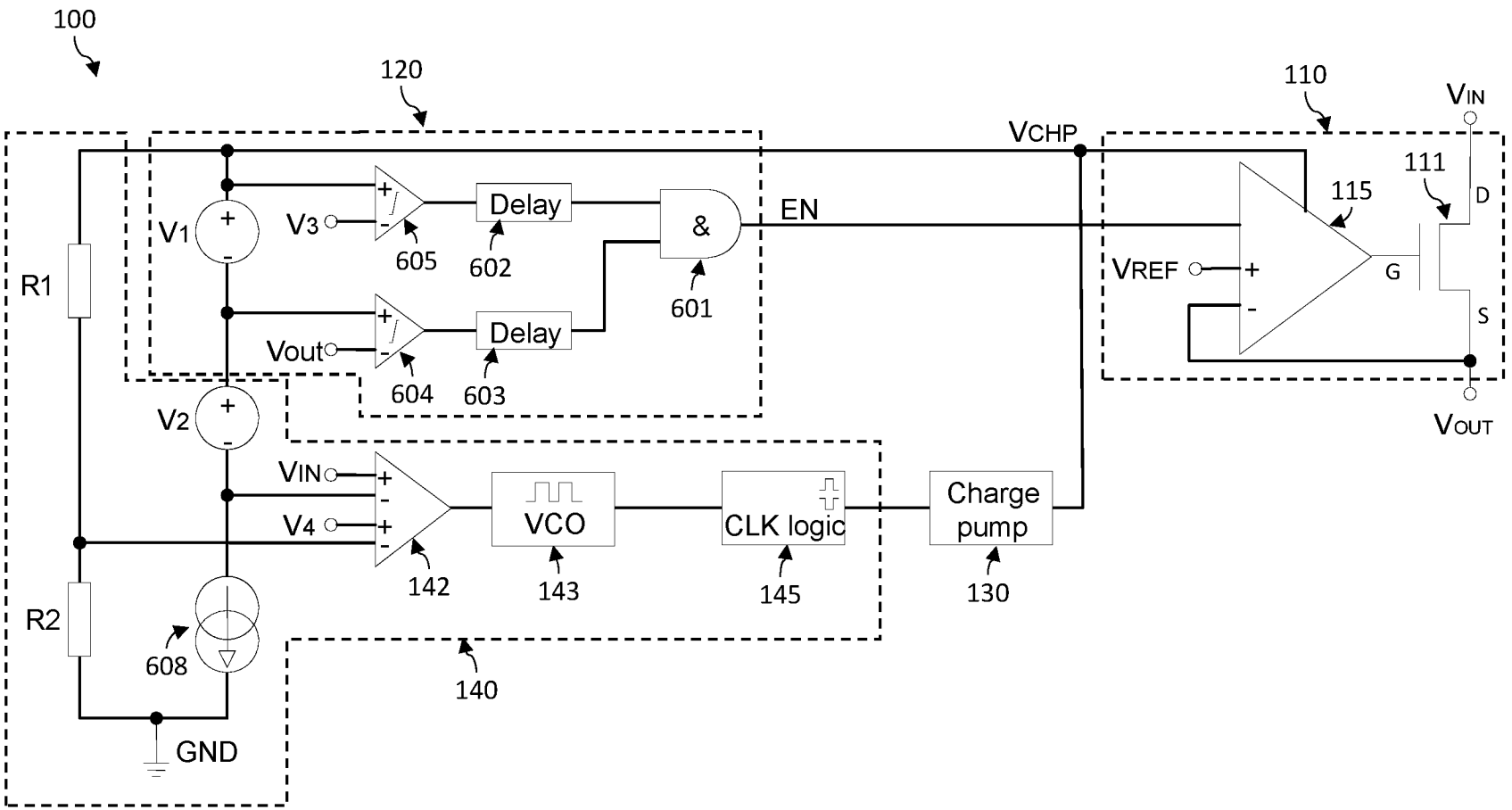
FIG. 6 is a schematic representation of a possible circuit implementation of the voltage regulator system of FIG. 1.

FIG. 6 is a schematic of a possible implementation of the voltage regulator system of FIG. 1. The system includes the voltage regulator with a NMOS switching device having a drain terminal (D), a source terminal (S), and a gate terminal (G). The gate terminal is coupled to, and receives a voltage from, a driver circuit 115. The voltage at the gate terminal (G) controls the conduction between the drain terminal (D) and the source terminal (S) so that a voltage at the source terminal (i.e., $V_{OUT}$) is lower than a voltage applied to an input terminal (i.e., $V_{IN}$) by a dropout voltage. The voltage at the source terminal (i.e., $V_{OUT}$) is fed back to an input of the driver where it is compared by an amplifier (i.e., difference amplifier, error amplifier) to a reference voltage generated by an internal voltage reference.

The driver 115 is powered by a voltage (i.e., $V_{CHP}$) provided by a charge pump 130. The amplitude of charge pump voltage is controlled by (complementary) clock signals coupled to the charge pump from clock logic 145. In particular, a VCO 143 may control the clock signals to adjust the charge pump voltage ($V_{CHP}$) based on the input voltage ($V_{IN}$) as long at the $V_{CHP}$ does not exceed a maximum voltage. The control of the VCO is carried out by a differential amplifier 142 that is configured to receive four input signals (i.e. two input pairs) for comparison. One of the inputs to the differential amplifier 142 is coupled to a voltage divider that includes a first resistor R1 and a second resistor R2. Another of the inputs to the differential amplifier is coupled to a first voltage reference V1, a second voltage reference V2, and a current source 608. The first voltage reference V1, the second voltage V2, and the current source may be implemented, in one possible embodiment, as resistors that are coupled in series with a transistor device.

The differential amplifier 142 receives four input signals: $V_{IN}$, $(V_{CHP}-V_1-V_2)$, $V_4$, and $V_{CHP}*R_2/(R_1+R_2)$. The amplifier may be embodied as a four-input operational amplifier (i.e., opamp) that includes two differential stages. The first differential stage is for the maximal allowed charge pump voltage $V_4*(1+R_1/R_2)$. $V_4$ is the voltage resulting from the voltage divider when the charge pump voltage is maximum. The voltage divider is used because it is not possible for this circuit to compare the charge pump voltage directly.

The second differential stage is for a comparison of $V_{IN}$ with Vchp$-V_1-V_2$. $V_1$ is a floating voltage referred to \imp and represents the minimum voltage difference (e.g., 1 V) between the gate terminal (G) and the source terminal (S) of the transistor device (e.g., power NMOS) to provide sufficient output current. $V_2$ is a voltage reference (e.g., 0.3 V) that floats below $V_{CHP}$ voltage and $V_1$.

The driver 115 is enabled by a digital signal (EN) determined by a UVLO circuit 120. The UVLO circuit receives the charge pump voltage ($V_{CHP}$). The UVLO circuit 120 includes a voltage reference ($V_1$) (e.g., Zener diode) which is the minimum voltage difference (e.g. ~1V) between the gate terminal (G) and the source terminal (S) of the transistor device (e.g., power NMOS) to provide sufficient current at the LDO output. The UVLO circuit 120 includes a first comparator 605 that outputs a logical high signal if the charge pump voltage ($V_{CH}$) is greater than a voltage $V_3$, which is the minimum charge pump voltage. In other words, $V_3$ is the minimum charge pump voltage ($V_{CHP_MIN}$) for the minimum input voltage ($V_{IN}$). The UVLO circuit 120 also includes a second comparator 604 that outputs a logical high signal if the charge pump voltage ($V_{CHP}$) is greater than the output voltage (i.e. the voltage of the source (S) terminal) by an amount sufficient cause the power NMOS transistor 111 to conduct (i.e., turn ON). The UVLO circuit includes an AND gate 601, which outputs a logical high if both conditions determined by the comparators 604, 605 are true. Thus, the driver is enabled if both the charge pump voltage is greater than a minimum voltage and is sufficient to control the NMOS transistor 111. In some implementations, the UVLO circuit can includes delay circuits 602, 603 at the inputs to the AND gate in order to prevent instabilities.

Some conditions for the system shown in FIG. 6 are summarized in TABLE 1 below.

TABLE 1

| Conditions for control of the voltage regulator system of FIG. 6 | |
|---|---|
| UVLO Control (EN) | |
| 1. | $V_{CHP_MIN} = V_3$ |
| 2. | $V_{CHP} > V_{OUT} + V_1$ |
| Charge Pump Control ($V_{CHP}$) | |
| 1. | $V_{CHP} = V_{IN} + V_1 + V_2$ |
| 2. | $V_{CHP_MAX} = V_4 * (1 + R_1/R_2)$ |

In what follows, a particular operating scenario is described as an example to help understanding. In the scenario, the transistor device 111 is an N-channel MOSFET with a safe operating area (SOA) of 3.6V, a threshold voltage of 0.7V, and an ON voltage 1.3V at 4 amps. In the operating scenario, $1.1 \leq V_{IN} \leq 3.6V$. In the operating scenario, $V_1$=1V, $V_2$=0.3 V, $V_3$=2.2V, and $V_4$=0.8 V.

Initially in the operating scenario, $V_{OUT}$ is zero. When an input voltage $V_{IN}$ is applied to the LDO, the charge pump starts and increases the $V_{CHP}$ voltage to a level determined by the charge pump control circuit 140 (i.e., the differential amplifier 142). The charge pump voltage is monitored by the UVLO circuit. When $V_{CHP}$ is greater than $V_{OUT}$ by $V_1$ (i.e., $V_{CHP}-V_{OUT}>1V$) and when $V_{CHP}$ is above a minimum voltage level $V_3$ (i.e., $V_{CHP}>2.2V$) then the UVLO circuit enables the LDO driver (i.e., EN=logical high).

In the operating scenario, the differential amplifier 142 controls VCO so that $V_{CHP}$ is above $V_{IN}$ (i.e., $V_{CHP}=V_{IN}+0.3+1.0$). The charge pump could be controlled to output even higher voltages for operation but that would be inefficient as power consumption is increased with oscillator frequency. Thus an advantage of the disclosed systems and methods is the control of $V_{CHP}$ based on $V_{IN}$ for efficient operation. In other words, $V_{CHP}$ tracks $V_{IN}$ at a voltage that suitable LDO regulation but is not so high as to be inefficient because the tracking prevents the need to select one $V_{CHP}$ that is higher than all possible $V_{IN}$.

In the operating scenario as $V_{IN}$ is increase, $V_{IN}$+1.3 V could become larger than a safe operating area (SOA) voltage 3.6 V for the transistor technology. In this case, the divided voltage across resistor $R_2$ exceeds $V_4$. Second differential stage of the differential amplifier 142 is turned off and the frequency is lowered so that the charge pump voltage is clamped at a stable voltage maximum voltage of 3.6 V. The division of the voltage across the resistor $R_2$ may be used to adjust the input voltage of the differential amplifier 142 to be within the amplifier's operating voltage range.

In the operating scenario, the first comparator 605 determines if the charge pump voltage exceeds 2.2V (i.e., the minimum charge pump voltage). The system may receive input voltages in the range of 1.1V to 3.6V. The minimum input voltage is 1.1 volt which implies that for efficient operation the minimum charge pump voltage is 1.1+1.3=2.4V (i.e., $V_{IN}+V_1+V_2$). To prevent the effects of voltage spikes this voltage may be reduced slightly (e.g., 0.2V), leading to a minimum charge pump voltage (i.e., $V_3$) for all conditions as 2.2 V.

In the operating scenario, the second comparator ensures that charge pump voltage $V_{CHP}$ exceeds $V_{OUT}$ by at least 1V (i.e., $V_1$). This condition ensures that a minimal voltage difference between the gate (G) and the source (S) of the power NMOS provides sufficient output current.

The system combines grounded and floating conditions of under voltage lockouts to ensure efficient charge pump operation within the LDO regulator's optimal modes. The applied conditions drive the charge pump to output an optimal voltage with respect to $V_{IN}$. The applied conditions also ensure that the charge pump voltage does not exceed a maximum voltage (e.g., defined by a process SOA). The applied conditions also ensure that the charge pump voltage is above an input to the LDO (i.e., $V_{IN}$) by at least a minimum voltage. The applied conditions also ensure that the charge pump voltage is at a particular voltage level above an output of the LDO (i.e., $V_{OUT}$). The applied conditions use floating voltages (i.e., $V_1$, $V_2$) that are referenced to the charge pump voltage.

Figure 7:
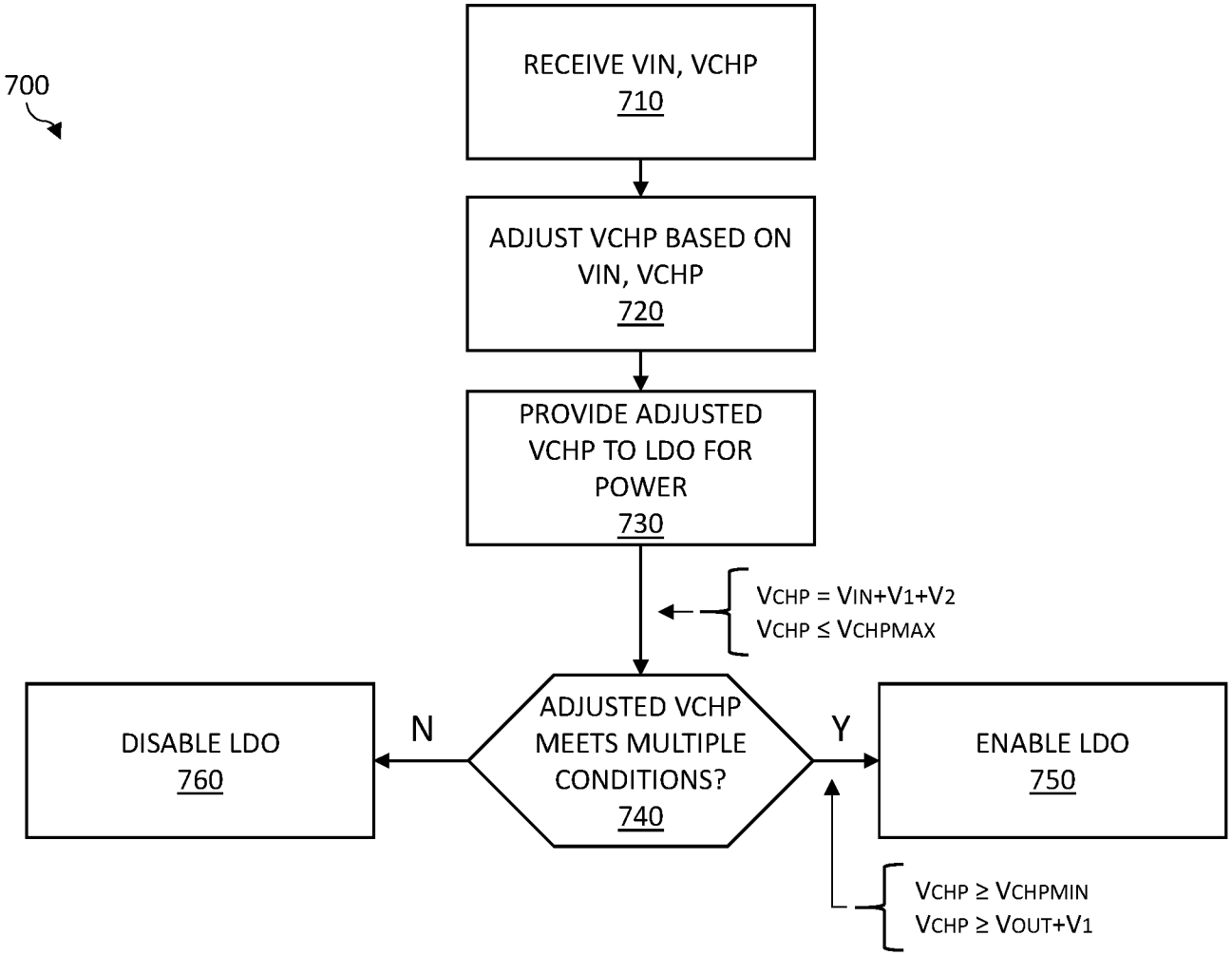
FIG. 7 is a flowchart of a method for controlling a low dropout regulator according to an implantation of the present disclosure.

A flow chart for one possible implementation of a method for controlling a low dropout regulator (LDO) is shown in FIG. 7. In the method 700, the input voltage $V_{IN}$ and the charge pump voltage ($V_{CHP}$) are received 710 (e.g., by the charge pump control circuit 140). Based on $V_{IN}$ and $V_{CHP}$, the charge pump is controlled to adjust (e.g., raise, lower, maintain) the charge pump voltage ($V_{CHP}$) and provide 730 (i.e., couple, transmit) the adjusted charge pump voltage to the LDO for power (to energize and operate circuitry). Additionally it is determined (e.g., by the UVLO circuit 120) if the adjusted $V_{CHP}$ meets multiple conditions, and if so, the LDO is enabled 750, otherwise it is disabled 750.

In the specification and/or figures, typical embodiments have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

Unless defined otherwise, all technical and scientific terms used herein have the same meaning as commonly understood by one of ordinary skill in the art. Methods and materials similar or equivalent to those described herein can be used in the practice or testing of the present disclosure. As used in the specification, and in the appended claims, the singular forms "a," "an," "the" include plural referents unless the context clearly dictates otherwise. It will be further understood that the endpoints of each of the ranges are significant both in relation to the other endpoint, and independently of the other endpoint.

It will be understood that, in the foregoing description, when an element, such as a layer, a region, a substrate, or component is referred to as being on, connected to, electrically connected to, coupled to, or electrically coupled to another element, it may be directly on, connected or coupled to the other element, or one or more intervening elements may be present. In contrast, when an element is referred to as being directly on, directly connected to or directly coupled to another element or layer, there are no intervening elements or layers present. Although the terms directly on, directly connected to, or directly coupled to may not be used throughout the detailed description, elements that are shown as being directly on, directly connected or directly coupled can be referred to as such. The claims of the application, if any, may be amended to recite exemplary relationships described in the specification or shown in the figures.

As used in this specification, a singular form may, unless definitely indicating a particular case in terms of the context, include a plural form. Spatially relative terms (e.g., over, above, upper, under, beneath, below, lower, and so forth) are intended to encompass different orientations of the device in use or operation in addition to the orientation depicted in the figures. In some implementations, the relative terms above and below can, respectively, include vertically above and vertically below. In some implementations, the term adjacent can include laterally adjacent to or horizontally adjacent to.

Some implementations may be implemented using various semiconductor processing and/or packaging techniques. Some implementations may be implemented using various types of semiconductor processing techniques associated with semiconductor substrates including, but not limited to, for example, Silicon (Si), Gallium Arsenide (GaAs), Gallium Nitride (GaN), Silicon Carbide (SiC) and/or so forth.

While certain features of the described implementations have been illustrated as described herein, many modifications, substitutions, changes, and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components, and/or features of the different implementations described.

The invention claimed is:

1. A voltage regulator system comprising:

a low dropout regulator (LDO) configured to receive an input voltage at an input terminal of a transistor device and provide a regulated output voltage at an output terminal of the transistor device;

a charge pump configured to output a charge pump voltage that powers a driver of the LDO;

a charge pump control circuit configured to control the charge pump so that the charge pump voltage is (i) higher than the input voltage and (ii) does not exceed a maximum voltage to prevent damage; and an under voltage lockout circuit configured to enable the LDO when the charge pump voltage is (i) higher than a minimum voltage for operation of the LDO and (ii) higher than the regulated output voltage.

2. The voltage regulator system according to claim 1, wherein the transistor device is an N-channel metal oxide semiconductor field effect transistor (MOSFET) controlled by the driver.

3. The voltage regulator system according to claim 2, wherein the minimum voltage corresponds to a voltage between a gate terminal and a source terminal of the N-channel MOSFET to provide a non-zero output current to the output terminal of the LDO.

4. The voltage regulator system according to claim 2, wherein the maximum voltage to prevent damage corresponds to a safe operating area (SOA) of the N-channel MOSFET.

5. The voltage regulator system according to claim 1, wherein the charge pump is a cross coupled symmetrical charge pump.

6. The voltage regulator system according to claim 1, wherein the charge pump voltage corresponds to a frequency of a clock signal from the charge pump control circuit.

7. The voltage regulator system according to claim 6, wherein the frequency of the clock signal is controlled by a voltage controlled oscillator driven by a differential amplifier of the charge pump control circuit.

8. The voltage regulator system according to claim 7, wherein the differential amplifier is a four input operational amplifier.

9. The voltage regulator system according to claim 7, wherein the differential amplifier outputs a voltage that floats relatively higher than the input voltage by a fixed amount when the charge pump voltage is less than the maximum voltage to prevent damage.

10. The voltage regulator system according to claim 9, wherein the fixed amount is determined by operating characteristics of transistor device of the LDO.

11. A circuit for control of a low dropout regulator (LDO), the circuit comprising:

a charge pump control circuit configured to receive an input voltage from an input terminal of the LDO and a charge pump voltage fed back from an output of a charge pump, and to control the charge pump to output the charge pump voltage based on the input voltage and the charge pump voltage fed back from the output, the charge pump voltage providing power to a driver of the LDO; and an under voltage lockout (UVLO) circuit configured to receive the charge pump voltage and to enable the LDO when the charge pump voltage satisfies a plurality of conditions.

12. The circuit for control of an LDO according to claim 11, wherein the charge pump control circuit is further configured to control the charge pump to change the charge pump voltage according to a corresponding change in the input voltage.

13. The circuit for control of an LDO according to claim 11, wherein the charge pump control circuit is further configured to control the charge pump to limit the charge pump voltage to a maximum voltage determined by a safe operating area (SOA) of the LDO.

14. The circuit for control of an LDO according to claim 11, wherein the plurality of conditions includes the charge pump voltage exceeding a minimum voltage.

15. The circuit for control of an LDO according to claim 11, wherein the plurality of conditions includes the charge pump voltage exceeding an output voltage from an output terminal of the LDO by a voltage determined by a transistor device in the LDO.

16. The circuit for control of an LDO according to claim 11, wherein the charge pump control circuit includes a four input operational amplifier.

17. The circuit for control of an LDO according to claim 11, wherein the UVLO circuit includes a comparator for each of the plurality of conditions and an AND gate that receives the output from each comparator.

18. A method for controlling a low dropout regulator (LDO), the method comprising:

receiving an input voltage from an input of the LDO;

receiving a charge pump voltage fed back from an output of a charge pump;

adjusting the charge pump voltage based on the received input voltage and the received charge pump voltage;

providing the adjusted charge pump voltage to the LDO to power a driver of the LDO;

determining that the adjusted charge pump voltage satisfies a plurality of conditions; and enabling the driver of the LDO for operation based on the determination.

19. The method according to claim 18, wherein the adjusting the charge pump voltage based on the received input voltage and the received charge pump voltage includes:

increasing or decreasing the charge pump voltage according to a corresponding increase or decrease in the input voltage; and limiting the charge pump voltage to a maximum voltage.

20. The method according to claim 18, wherein the determining that the adjusted charge pump voltage satisfies the plurality of conditions includes:

comparing the adjusted charge pump voltage to a minimum voltage; and comparing the adjusted charge pump voltage to an output voltage from an output of the LDO.

* * * * *